US005192168A

United States Patent [19]

Massarsch et al.

[11] Patent Number: 5,192,168

[45] Date of Patent: Mar. 9, 1993

[54] METHOD AND APPARATUS FOR STABILIZING FRICTION SOIL AND ADJACENT COHESION SOIL LAYERS

[75] Inventors: Karl R. Massarsch, Waterloo, Belgium; Günter Heppel, Marburg an der Lahn, Fed. Rep. of Germany

[73] Assignee: Dr.-Ing. Ludwig Muller & Sohne Gesellschaft fur Bautechnik mbH & Co. KG, Marburg an der Lahn, Fed. Rep. of Germany

[21] Appl. No.: 876,232

[22] Filed: Apr. 30, 1992

[30] Foreign Application Priority Data

May 1, 1991 [DE] Fed. Rep. of Germany ..... 4114193

[51] Int. Cl.[5] ..... E02D 7/18

[52] U.S. Cl. ..... 405/258; 405/232; 405/244; 405/271

[58] Field of Search ..... 405/228, 229, 231, 232, 405/244, 245, 258, 259.1, 269, 271, 274; 175/19, 55, 56

[56] References Cited

U.S. PATENT DOCUMENTS

| | | | |
|---|---|---|---|
| 3,722,600 | 3/1973 | Hirata et al. | 405/232 X |
| 3,865,501 | 2/1975 | Kniep | 405/271 X |
| 3,975,917 | 8/1976 | Asayama | 405/232 |
| 4,080,792 | 3/1978 | Anderson et al. | 405/271 |
| 4,094,156 | 6/1978 | Dumont | 405/274 |

FOREIGN PATENT DOCUMENTS

0203137B1 5/1985 European Pat. Off. .

*Primary Examiner*—David H. Corbin
*Attorney, Agent, or Firm*—Herbert Dubno

[57] ABSTRACT

Soil nails are entrained into the ground by vibration of a beam or compaction probe into the ground and remain behind when the beam is removed to transfix a friction soil layer and anchor it to the cohesion soil layer.

14 Claims, 3 Drawing Sheets

METHOD AND APPARATUS FOR STABILIZING FRICTION SOIL AND ADJACENT COHESION SOIL LAYERS

FIELD OF THE INVENTION

Our present invention relates to a method of stabilizing a friction soil relative to an adjacent cohesion soil layer and to an apparatus for carrying out this method.

BACKGROUND OF THE INVENTION

In the stabilization of a friction soil and an adjacent column soil layer, it is known from EP-B 0 203 137, for example, to sink a compaction probe of substantially constant longitudinal cross section through the soil strata utilizing a vibrator attached at an upper end to the compaction probe. The latter, which can be a beam or bar, is subsequently extracted from the soil by vibration.

Building loads can be transferred from the ground surface to underlying soil or rock strata by the use of pile foundations. The piles which are used for this purpose are driven into the ground by boring, ramming or vibrating.

In many cases the piles are loaded to their maximum extent during the driving phase and it is this brief phase which is critical for pile design since long-term loading by the building may not place as much stress upon the pile.

Pile foundations, therefore, are most economical in the case of highly concentrated building loads. In more frequent cases, however, the loads are lighter and for residential and industrial buildings of medium height, for embankments and the like, the load bearing capacity of piles is not fully utilized. In such cases sufficient bearing strength can be obtained by soil stabilization techniques.

When one refers to soil stabilization, one must distinguish between fine-grained soils, so-called cohesive or cohesion soils, and coarse-grain, water-permeable soils which are referred to as friction soils.

The loading of fine-grain soil can result in settlement only after long periods of time, measured in years. Settlement can occur in coarse-grain or friction soils in much shorter periods of time measured in minutes or days. The different soil properties have had a significant influence on the choice of the soil stabilization method.

The various soil stabilization methods which have been used in the past have been developed in response to various requirements. In friction soils, for example, driving, vibrating or oscillating methods are primarily employed. The increased bearing capacity of these soils results from the dynamic forces applied as for example in the case of a vibrofloatation technique or resonance compaction. In the resonance compaction approach, the specially designed compaction probe or bar is vibrated vertically into the soil and the vibration frequency of the vibrator attached to the bar is set to a resonance frequency of the soil deposit to achieve the most effective soil compaction.

The strength of fine-grain soils, such as silt or fine sand, can be improved by adding material of greater bearing capacity like coarser sand or gravel, and simultaneously imparting a mechanical treatment by ramming or vibrating for example.

The result may be pillar-like columns of sand or gravel often required to as "stone" columns which, however, have limited bearing capacity.

To improve soils to great depths by this method, specialized machines have been developed which can penetrate into the soil to be improved by vibration flushing or other mechanical procedures involving pushing or screwing in order to produce the stabilized columns.

In cohesive soils such as clays, oscillating or vibrating methods are not applicable. In such cases it is possible to mix into the soil, certain stabilizing substances like cement, fly ash or lime which react with the surrounding soil and can set to produce stabilized soil columns. This method becomes significantly more expensive with increasing depth and can only be utilized with certain fine-grain soil types.

It is also possible to improve fine-grain soils by installing vertical drain elements in the soil. These elements are usually not load bearing or even soil stabilizing elements, being of insufficient stiffness. They do serve to increase the permeability of the soil in order to dissipate water and reduce the water pressure in the interstices of the soil. Drainage improvement, therefore, most often must be combined with other methods, like static preloading which increases the rate of soil settlement, after which a structure can be applied to the ground. While this method is of relatively low cost, it is very time consuming and is not practical in many cases. The drain structures can be composed of coarse grained material like sand, waste products from industry like gypsum or fly ash or from synthetic materials such as plastics and reinforced cardboard. The drain elements can be installed in the soil by pushing, vibration, driving, flushing or a combination thereof.

In construction, mixed soil deposits frequently are encountered. Such mixed deposits can consist of both fine grain and coarse grain soil strata. As a result it has been difficult in the past by any single method to provide a technological satisfactory and economical ground stabilization. For example, when one uses the vibroflotation method, sand layers can be effectively stabilized but intermediate layers of clay or silt are not positively affected by the method.

It may be mentioned that a new approach to soil stabilization, referred to as soil nailing, has been developed for the stabilization of slopes and excavations. In this method, long stiff elements (rods or soil nails or concrete) are driven or bored into the soil. The soil nails are installed with a small spacing from one another (about 0.5 to 1.5 m), i.e. a spacing much smaller than that used with piles in the formation of pile foundations. The soil nails, without providing a material load supporting effect in themselves, impart to the soil a reinforcement enabling the building loads to be carried by the reinforced soil primarily and only partially by the soil nails themselves.

This technique has not been widely used to solve foundation problems occurring with other approaches primarily because of the difficulty of installing safely, with precision and with the requisite closeness of spacing of the long but slender nails which can have diameters of 2 to 200 mm and lengths of up to 20m.

OBJECTS OF THE INVENTION

It is, therefore, the principal object of the invention to provide an improved method of soil stabilization so as to increase the load carrying capacity of a soil by comparison with earlier methods, which is applicable to mixed soil strata and especially the stabilization of friction soils adjacent cohesive or cohesion soils, whereby drawbacks of earlier techniques are avoided.

Another object of this invention is to provide a method of installing soil nails of the types and dimensions described, in especially mixed soil strata in an economical and effective manner.

Still another object of the invention is to provide a method of soil stabilization which can be effected economically and nevertheless renders the soil highly load bearing.

It is also an object of this invention to provide an improved apparatus for carrying out the method, i.e. an apparatus for stabilizing the soil utilizing the soil nailing technique.

SUMMARY OF THE INVENTION

These objects are attained, in accordance with the invention, by a method of stabilizing the soil or the ground, where at least one layer or stratum of friction soil lies adjacent at least one layer or stratum of cohesion soil and which comprises the steps of:

(a) affixing to a compaction beam at least one ground nail in a form of an elongated rod;

(b) vibrating the beam with the ground nail affixed thereto into the ground through the friction soil and an adjacent cohesion soil layer with a vibrator attached to an upper end of the beam; and (c) thereafter withdrawing the beam from the ground while vibrating the beam and leaving the ground nail in the ground after extraction of the beam whereby the ground nail transfixes the friction soil and at least a portion of a cohesion soil layer.

The apparatus for this process can thus comprise:

a compaction beam of generally constant cross section;

a plurality of holders on the beam;

at least one ground nail in a form of an elongated rod releasably engaged by the holders and entrainable by the beam into the ground; and a vibrator on a top of the beam for vibrating the beam with the ground nail affixed thereto into the ground through the friction soil and an adjacent cohesion soil layer and thereafter withdrawing the beam from the ground while vibrating the beam and leaving the ground nail in the ground after extraction of the beam whereby the ground nail transfixes the friction soil and at least a portion of a cohesion soil layer.

According to the invention, therefore, the reinforcing nails are installed in the ground by vibrating the beam, formed as a compaction probe into the soil through at least one of the layers and into the other layer, the nails remaining in the soil after extraction of the compaction probe. The nails can be rods of steel, slack or prestressed reinforced concrete, plastic (synthetic resin), wood or bamboo.

To improve the load transfer from the stiffer soil layer to the softer soil layer, the soil nails can be provided at their upper and/or lower ends with enlargements. In all cases the nails are provided so that they are automatically released from the respective holders as the compaction probe or beam is withdrawn from the ground while being vibrated.

The holders can be flanges formed on edges of the beam and, for that purpose, the compaction probe or beam may be a profiled structural shape having a plurality of webs with respective edges along which the holders or flanges are spaced. The flanges can be formed as closed entrainment sleeves or can be slotted to facilitate release or insertion of the nails or rods and, to insure the entrainment of the rods into the ground, at least one holder for each rod is provided at the lower end of the respective beam.

According to another feature of the invention, the compaction beam or probe can have a double-V cross section with the vertices of the two V's being connected by a web, plate or bar. The free ends of the V arm create a rectangular periphery which has been found to be highly effective, when the beams are vibrated into the ground in a grid pattern, to compact and densify the soil. A particularly close spacing of the nails entrained by the edges of the beam into the ground can also be thus insured. The flanges or holders for the soil nails can be located at free ends of the arm of the beam which are thus formed.

In construction friction soils, such as gravel or sand, frequently are interlayered with fine-grained soils such as silt or clay, and can be improved or stabilized by a combination of vibratory compaction in friction soils and soil nailing in cohesive soils, thus offering a new and effective method to improve these soil systems.

Resonance compaction is an effective method for the improvement of friction soils. In resonance compaction, the compaction probe, which can be a thin-walled steel beam with a vibrator attached to then upper end is vibrated into the soil. As a result of the generated vibration energy friction soils are effectively densified. The compaction probe offers also the possibility of drainage of excess pore water, which is of particular advantage in stratified soils. The fine-grained soils, however, are hardly influenced by the vibration.

In these ground conditions, soil nailing is effective. The apparatus which was developed for resonance compaction, consisting of a compaction probe and a vibrator, can also be used to install the slender nails in deep soil layers, whereby the nails are attached to the probe and subsequently vibrated into the soil. The length and position of the nails can be matched to the soil conditions with the aid of the compaction probe.

The soil nails can in certain cases also reach deeper into the soil than the compaction probe, when for example a cohesive soil layer occurs below a friction soil layer. The slender nails are pulled downwardly by the compaction probe with high precision in a simple and careful manner into the ground and are fixed in their lateral position by the compaction probe. During the insertion of the compaction probe several nails can of course be installed simultaneously.

When the required depth has been reached, the soil nails are released, which in the simplest case is achieved by extraction of the probe. The releasing of the soil nails from the probe can also be achieved by a variety of conventional anchoring methods.

The soil nails can further be provided at the lower end with arrangements which facilitate the attachment them to the compaction probe or beam, for example by fork-like formations. The soil nails can be installed depending on the geotechnical conditions before, during or at the end of the soil compaction. They can be round or flat but their shape can vary within wide limits. The soil nails can be clamped to the upper end of the compaction probe to fix their position and to avoid to large tension forces in the reinforcing elements. In certain soil conditions the nails can be installed by a combination of vibration, driving and pushing of the compaction beam. This installation method using the compaction beam makes it possible to choose the diameter of the nail elements independently of the installation process and adapt the nail dimensions spacing to the foundation requirements.

The shape of the compaction probe has great significance in order to achieve effective soil densification and soil nailing. Of special advantage are the already described implementation shapes. In any case the shape of the compaction probe or beam should be chosen with respect to the geotechnical conditions in such a way that homogeneous respectively dense soil nailing can be achieved. In this respect a compaction probe with a double V-shaped cross section and a plate connecting the V-edges; such a compaction probe can also be employed solely for soil compaction, i.e. without soil nailing.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
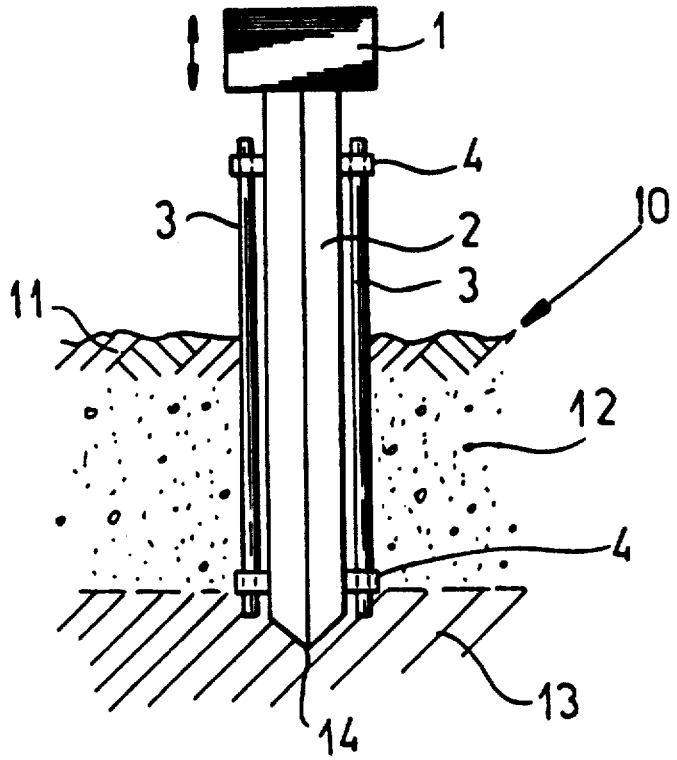
FIG. 1 is a cross sectional view diagrammatically illustrating an early stage in the sinking of a plurality of soil nails with resonance compaction into the ground.
Figure 2:
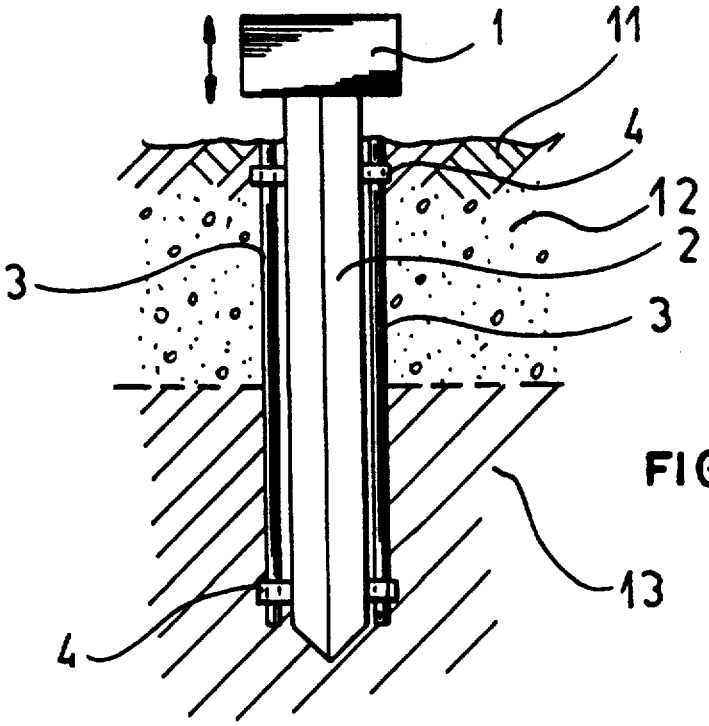
FIG. 2 is a diagram similar to FIG. 1 of the stage at which withdrawal of the compaction of the probe or beam is about to commence and the soil nails have been fully emplaced.
Figure 5:
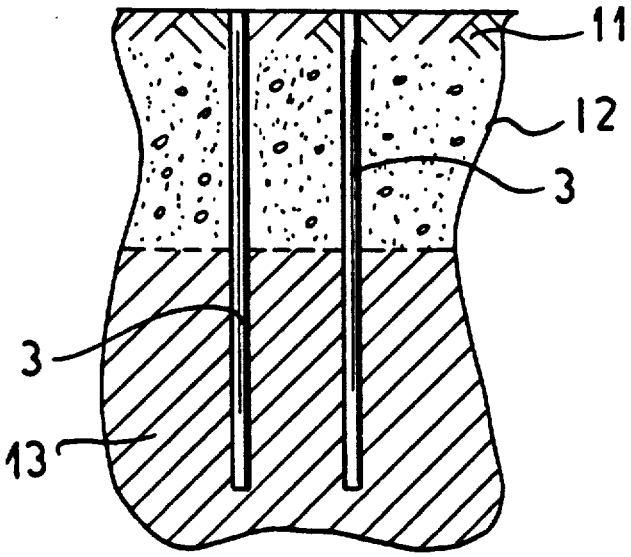
FIG. 5 is a view similar to FIG. 2 after extraction of the compaction probe or beam.

In FIGS. 1, 2 and 5, the mixed-strata ground structure 10 is shown to consist of a topsoil layer 11 above a coarse-grained or friction stratum 12 overlying a cohesion stratum 13. The compaction probe or beam 2 which can have the configuration of FIG. 3 and hence any of the configurations of FIGS. 4*a*–4*c*, can be of uniform cross section over its length except for a print 14 and can be formed with openings 15, for example, in the arms 16 thereof which have edges 17 along which the flanges or holders 4 are spaced to entrain the soil nails 3 into the ground and enable them to be released therein automatically.

Figure 3:
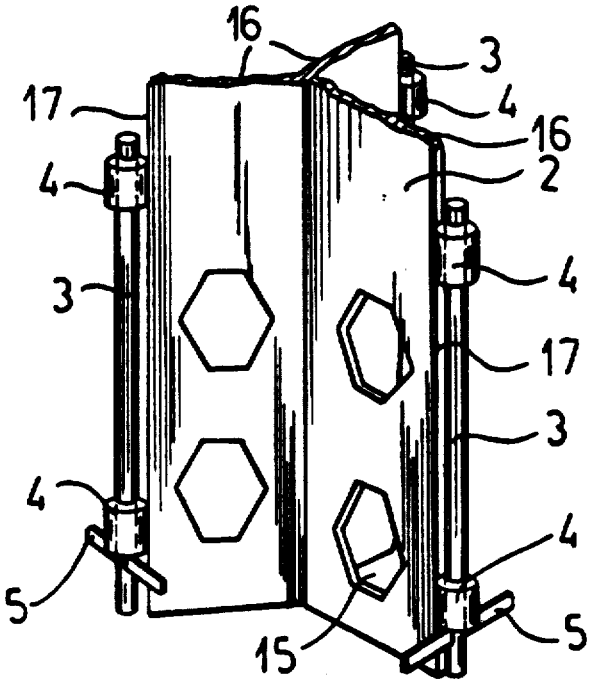
FIG. 3 is a fragmentary perspective view showing a portion of the compaction probe or beam.
Figure 4B:
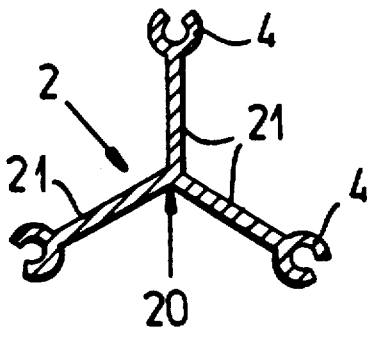
FIGS. 4*a*–4*c* are cross sectional views through compaction beams of different cross section.
Figure 4A:
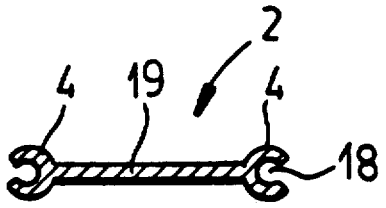

As shown in FIG. 3, the soil nails 3 can have lateral bars or cross basis 5 which enable to lower most holders 4, configured as sleeved which can be provided with lateral slots 18 as shown in FIG. 4*a*, draw the nails 3 downwardly as the beam 2 is vibrated into the soil by a vibrator 1 affixed at the upper end of the beam 2, utilizing the resonance vibration technique described in EP-B 0 203 137 mentioned previously.

FIG., 1 shows the stage after the compaction probe and the soil nails 3 have been vibrated through the friction layer and initially begins to penetrate the cohesion layer 3.

FIG. 2 shows the stage at which the compaction beam 2 is about to be withdrawn, also with vibration, from the ground, leaving the nails behind.

When the beam is fully removed, the nails 3 remain and transfix at least the friction layer 12.

Figure 4C:
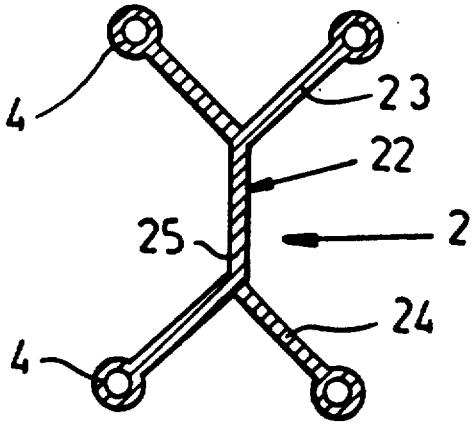

The beams can have the configuration shown in FIG. 4*a*, FIG. 4*b* or FIG. 4*c*. In FIG. 4*a*, the beam may be a steel plank 19 formed at its opposite longitudinal edges with the holders 4.

In the embodiment of FIG. 4*b*, the beam is of an angular structural shape represented at 20 with flanges, webs or arms 21 angularly equispaced from one another and formed at their edges with the holders 4.

The beam 22 shown in FIG. 4*c* as constituting the compaction probe 2 is of double-V configuration with each V 23, 24 connected to the other at the respective vertices by a web or plate 25. The arms of the V's including right angles with one another and are formed at their ends with the holders 4.

We claim:

1. A method of stabilizing friction soils and adjacent cohesion soil layers, comprising the steps of:

(a) affixing to a compaction beam at least one ground nail in a form of an elongated rod;

(b) vibrating said beam with said ground nail affixed thereto into the ground through said friction soil and an adjacent cohesion soil layer with a vibrator attached to an upper end of said beam; and (c) thereafter withdrawing said beam from the ground while vibrating said beam and leaving said ground nail in the ground after extraction of said beam whereby said ground nail transfixes the friction soil and at least a portion of a cohesion soil layer.

2. The method defined in claim 1 wherein said nail is selected from the group which consists of a steel, prestressed concrete, slack-reinforced concrete, plastic, wood and bamboo rod.

3. The method defined in claim 1 wherein said rod is formed with an enlargement at least at one end thereof.

4. The method defined in claim 1, further comprising the step of automatically decoupling said rod from said beam upon extraction of said beam from the ground.

5. The method defined in claim 1 wherein a plurality of said rods are entrained into the ground with said beam and are left in the ground upon extraction of said beam.

6. An apparatus for stabilizing friction soils and adjacent cohesion soil layers, comprising:

a compaction beam of generally constant cross section;

a plurality of holders on said beam;

at least one ground nail in a form of an elongated rod releasably engaged by said holders and entrainable by said beam into the ground; and a vibrator on a top of said beam for vibrating said beam with said ground nail affixed thereto into the ground through said friction soil and an adjacent cohesion soil layer and thereafter withdrawing said beam from the ground while vibrating said beam and leaving said ground nail in the ground after extraction of said beam whereby said ground nail transfixes the friction soil and at least a portion of a cohesion soil layer.

7. The apparatus defined in claim 6 wherein said beam is formed with holders entraining a plurality of said ground nails simultaneously into the ground.

8. The apparatus defined in claim 7 wherein said holders are sleeves receiving said ground nails.

9. The apparatus defined in claim 7 wherein said holders are provided at least at a lower end of said beam.

10. The apparatus defined in claim 7 wherein said beam has an open cross section formed with a plurality of arms at least one of said holders being provided along an outer edge formed by each of said arms.

11. The apparatus defined in claim 10 wherein said beam has a double-V cross section with a plate connecting vertices of the V's.

12. The apparatus defined in claim 11 wherein said holders are spaced apart along edges of the V's.

13. The apparatus defined in claim 6 wherein said nail is selected from the group which consists of a steel, prestressed concrete, slack-reinforced concrete, plastic, wood and bamboo rod.

14. The apparatus defined in claim 6 wherein said rod is formed with an enlargement at least at one end thereof.

* * * * *